US006837494B2

(12) United States Patent
Lee

(10) Patent No.: US 6,837,494 B2
(45) **Date of Patent: *Jan. 4, 2005**

(54) TABLE AND METHOD OF PLAYING A BACCARAT-TYPE CARD GAME

(76) Inventor: James C. Lee, 7154 Soaring Hawk Ct., Las Vegas, NV (US) 89113

( * ) Notice: Subject to any disclaimer, the term of this patent is extended or adjusted under 35 U.S.C. 154(b) by 0 days.

This patent is subject to a terminal disclaimer.

(21) Appl. No.: 10/299,082

(22) Filed: Nov. 19, 2002

(65) Prior Publication Data

US 2003/0151201 A1 Aug. 14, 2003

Related U.S. Application Data

(63) Continuation-in-part of application No. 10/073,580, filed on Feb. 12, 2002, now abandoned, and a continuation-in-part of application No. 10/121,138, filed on Apr. 12, 2002, now Pat. No. 6,588,758.

(51) Int. Cl.[7] ..... A63F 1/00
(52) U.S. Cl. ..... 273/292; 273/274; 463/13
(58) Field of Search ..... 273/292, 274; 463/11–13

(56) References Cited

U.S. PATENT DOCUMENTS 5,395,119 A * 3/1995 Jacob et al. ..... 273/274
6,299,171 B1 * 10/2001 Mollo et al. ..... 273/292
6,588,758 B1 * 7/2003 Lee ..... 273/292

* cited by examiner

*Primary Examiner*—Vishu K. Mendiratta
(74) *Attorney, Agent, or Firm*—Craig Weiss; Harry M. Weiss; Weiss, Moy & Harris, P.C.

(57) ABSTRACT

A table and method of playing a combined poker and baccarat-type card game. The method of playing a combined poker and baccarat-type card game comprises dealing 3 cards of both a banker hand and a player hand, with the winning baccarat hand having a higher hand value based on the traditional baccarat scoring system, but without all of the complex baccarat rules for determining if and when a third card is to be dealt. Included is the option of any player to select that the player hand of three cards or the banker hand of three cards or both the player hand and the banker hand will provide a bonus poker hand of one pair, a three-card flush, a three-card straight, three of a kind, a three-card straight flush and a three-card royal flush comprising an Ace and a King and a Queen of any one suit.

2 Claims, 1 Drawing Sheet

TABLE AND METHOD OF PLAYING A BACCARAT-TYPE CARD GAME

RELATED APPLICATIONS

This application is a continuation-in-part of Applicant's U.S. patent application entitled "TABLE AND METHOD OF PLAYING A BACCARAT-TYPE CARD GAME," Ser. No. 10/073,580, filed Feb. 12, 2002, which is now abandoned and also a continuation-in-part of Applicant's U.S. patent application entitled "TABLE AND METHOD OF PLAYING A COMBINATION POKER AND BACCARAT-TYPE CARD GAME," Ser. No. 10/121,138, filed Apr. 12, 2002, now U.S. Pat. No. 6,588,758.

FIELD OF THE INVENTION

This invention relates generally to card games and tables and methods therefor and, more particularly, to a table and method of playing a combination poker and baccarat-type card game that provides players with the opportunity to play a simpler version of baccarat with a poker option that is easier to understand and capable of being played by more players.

BACKGROUND OF THE INVENTION

The game baccarat is a popular card game at many casinos. Although usually found in a roped off or somewhat secluded area to attract high rollers or bettors seeking to gamble in relative privacy, baccarat is now played by many gamblers. The object of the game is to receive a hand value closest to 9. An Ace has a point value of 1 and cards 2 through 9 have point values equal to their face values (e.g. 3 of Spades has a point value of 3). 10s, Jacks, Queens and Kings have a point value of zero, Thus, if the first two cards dealt are a Jack and a 6, the total point value of the hand is 6. When the combination of cards creates a point total of 10 or more, the first digit is ignored. For example, a 4 and a 7 have a point value of 1 (not 11) Therefore, the highest point total that it is possible to achieve is a 9. Between the banker's hand and the player's hand, the hand value closest to 9 is the winning hand.

In baccarat, two cards are first dealt to a player's hand and two cards are first dealt to a dealer's, or banker's, or house hand. A two-card point total of 9 is called a "natural" and this hand cannot lose. A two-card point total of 8 is also called a "natural" and this is the second-best hand. In the event of a tie between the player's hand and the banker's hand neither the banker's hand nor the player's hand wins. Although, it is possible for the player to wager that a tie would occur, in which case the player is paid a multiple of his or her wager, usually the player is paid at a rate of 8 to 1. If the player or banker receive a two-card point total of 7, no further cards are received. No more than a total of 3 cards can be received, including the original two cards dealt.

When two-card point totals are 6 or less a very complex set of rules govern when the banker or player must draw an additional card. One of the dealers, known as the caller, determines the need for additional cards, which are dealt automatically and without direction or consent from the player. This method of play can be confusing, when one is not completely familiar with all of the rules governing card disbursement. The rules are often hard to pick up, causing many players to avoid the game of baccarat altogether.

It is also possible for the player to wager that the banker's hand (and not the player's hand) will win, although a successful wager on the banker's hand results in a 5% commission on the wager, paid to the casino. Since it is cumbersome to collect this sum each time a successful wager on the banker's hand is made, an additional dealer keeps track of what the player owes, and all debts are paid to the dealer once 8 decks of cards (known as the shoe) have been dealt. This method can create the feeling that one must pay the casino to win, a notion which can create some animosity and resentment when playing the game of baccarat. The 5% commission is also an additional calculation that must be taken into account by a gambler when determining his or her winnings. In the game of baccarat, the shoe is passed from player to player. When the player has the shoe, he or she must bet on the banker's hand, with the ensuing commission to be paid for a winning wager.

The game of baccarat can therefore create difficulties in determining the amount of winnings, and therefore the amount of money to wager, and the complex set of rules also makes the game of baccarat hard to follow.

The game of mini-baccarat has been developed to try and introduce the game of baccarat to more gamblers. The passing of the shoe and other customs of the traditional game of baccarat have been eliminated, but mini-baccarat follows the same rules of play as regular baccarat. For the most part, therefore, mini-baccarat retains the same shortcomings of regular baccarat. Mainly, the game of mini-baccarat was introduced as a way to place the smaller tables of mini-baccarat amongst the black-jack tables where there is more pedestrian traffic, and consequently, more likelihood of attracting gamblers.

As with virtually every game in a casino, the more players capable of playing the game, the more money a casino can make. Additionally, it is often the case that more players means more fun for the players, as a more social atmosphere is created by a larger group of people.

In my co-pending patent application noted above, I have disclosed a simpler baccarat-type game using three cards for the player and three cards for the banker, dealer or house. While my simpler baccarat-type game as disclosed in the co-pending patent application is a significant improvement over prior known baccarat games, I have now discovered an improved version thereof which provides a more interesting game with other betting options that could result in a bonus payback to the player successfully selecting one of the betting options that results in the player choosing one of the three card hands that is a bonus payback type three card hand.

Two prior art references, the U.S. patent application Ser. No. 09/841,174 that was filed on Apr. 25, 2001 in the name of Derek J. Webb and also his U.S. Pat. No. 6,328,306 that issued Dec. 11, 2001 (both with the same title "Method and Apparatus For Playing A Game with Numerical Result") disclose various types of baccarat games, but do not disclose my simplified combined game using both baccarat and poker concepts and a potential significant bonus payout.

A need therefore existed for providing a new, simpler table and method of playing a combined baccarat and poker-type card game with a significant bonus payout potential, without all of the complex rules regarding when a third card is received, with no 5% commission for successfully wagering on a banker's hand, and with the possibility of playing with additional players.

SUMMARY OF THE INVENTION

An object of the present invention is to provide a new method of playing a combined baccarat and poker-type card game in which both a banker hand and a player hand receives three cards, and following the baccarat rules of determining hand values, the score of the player hand and banker hand are compared, with the winner having the higher number, however, there is also provided a poker betting option with a bonus payout opportunity.

It is a further object of the present invention to provide an improved combined poker and baccarat-type card game table capable of allowing more than 6 players to wager on either a banker hand, a player hand, or on a tie between the banker hand and the player hand or on the chance of obtaining a poker hand that would qualify for a bonus payout.

BRIEF DESCRIPTION OF THE PREFERRED EMBODIMENTS

In accordance with one embodiment of the present invention, a method of playing a combined poker and baccarat-type card game is disclosed comprising, in combination, the steps of dealing a player hand having three cards, dealing a banker hand having three cards, determining a hand value of the player hand, wherein Ace through Nine cards have respective point values of 1 to 9 and wherein 10's and Jacks and Queens and Kings have a point value of zero, wherein a hand value of the player hand is equal to a total point value of the three cards of the player hand when the three cards have a total point value less than 10 and when the three cards of the player hand have a total point value of at least 10 then the first digit of the total point value is ignored when determining a hand value of the player hand, determining a hand value of the banker hand, wherein Ace through Nine cards have respective point values of 1 to 9 and wherein 10's and Jacks and Queens and Kings have a point value of zero, wherein a hand value of the banker hand is equal to a total point value of the three cards of the banker hand when the three cards have a total point value less than 10 and when the three cards of the banker hand have a total point value of at least 10 then the first digit of the total point value is ignored when determining a hand value of the banker hand, comparing the hand value of the player hand with the hand value of the banker hand wherein the hand with a higher hand value is a winning hand, and permitting, a player to select a poker hand from at least one of the player hand and the banker hand to permit the player to be eligible to receive a corresponding pair, flush, a straight, three of a kind, a straight flush, and a royal flush.

In accordance with another embodiment of the present invention, a combined poker and baccarat-type card game table is disclosed comprising, in combination, a table having a banker hand area dimensioned to receive three playing cards and a player hand area dimensioned to receive three playing cards, a plurality of individual betting locations located proximate an outer perimeter of the table, each of the individual betting locations has a banker hand wagering area designated for wagering on a banker hand and a player hand wagering area designated for wagering on a player hand, and a tie betting area located proximate the plurality of individual betting locations, the tie betting area is designated for wagering that the banker hand and the player hand will subsequently be determined to have an equal hand value, and areas located on the table for a player to wager that at least one of the banker hand and the player hand will receive a poker hand eligible to receive a corresponding bonus payout if any selected hand receives one of a pair, a flush, a straight, three of a kind, a straight flush, and a royal flush.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
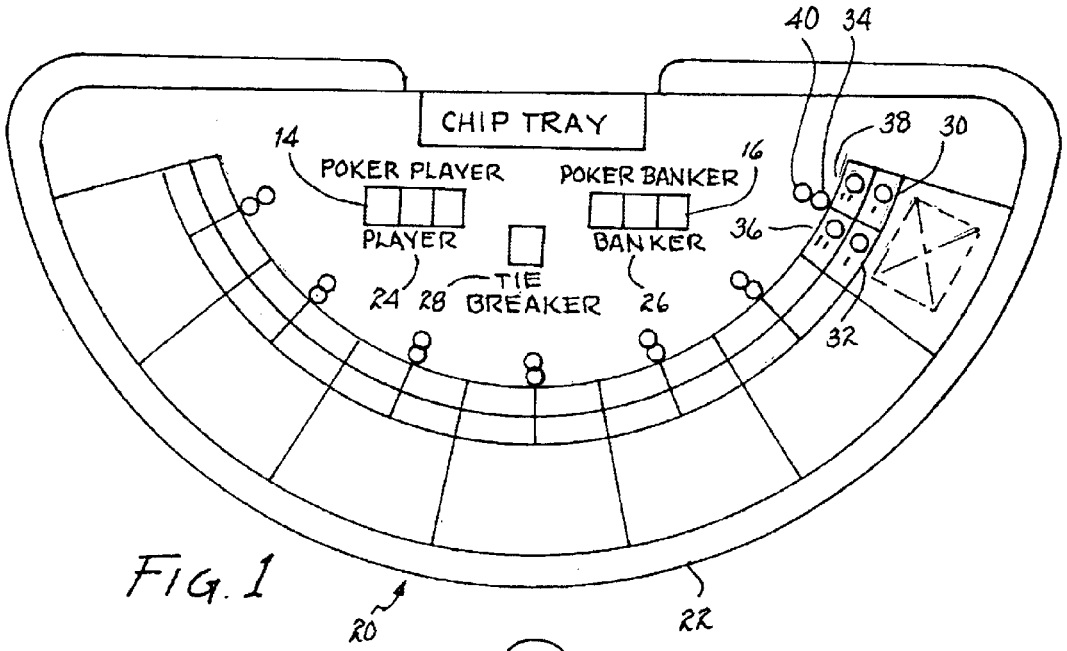
FIG. 1 is a top view of the preferred embodiment of the combined poker and baccarat-type card game table of the present invention.

The present invention includes both a method of playing a combined poker and baccarat-type card game and a table therefor. Referring now to FIG. 1, the first step in the method of playing the combined poker and baccarat-type card game is dealing a player hand 14 having three cards. The next step is dealing a banker hand 16 also having three cards.

In the method of this invention, the Ace through Nine cards have respective point values of 1 to 9, and 10's, Jacks, Queens and Kings have a point value of zero. The next step of the method of playing a combined poker and baccarat-type card game of this invention is determining a hand value of the player hand 14. This is done by adding up the individual point values of all three cards based on the point system discussed above. When the total point value of the three cards of the player hand 14 is less than ten, then the hand value is equal to the total point value. If the three cards have a total point value of at least 10, then the first digit of the total point value is ignored when determining the hand value. For example, if one of the hands comprised an 8, 3, and a Queen then even though the total point value would be 11, the hand value would be 1 since the first digit is dropped when establishing the hand value for a hand with a point value of at least 10.

After determining the hand value for the player hand 14, the hand value is determined for the banker hand 16. Then the hand value of the player hand 14 is compared to the hand value of the banker hand 16, wherein the hand with a higher hand value constitutes the winning hand.

Figure 2:
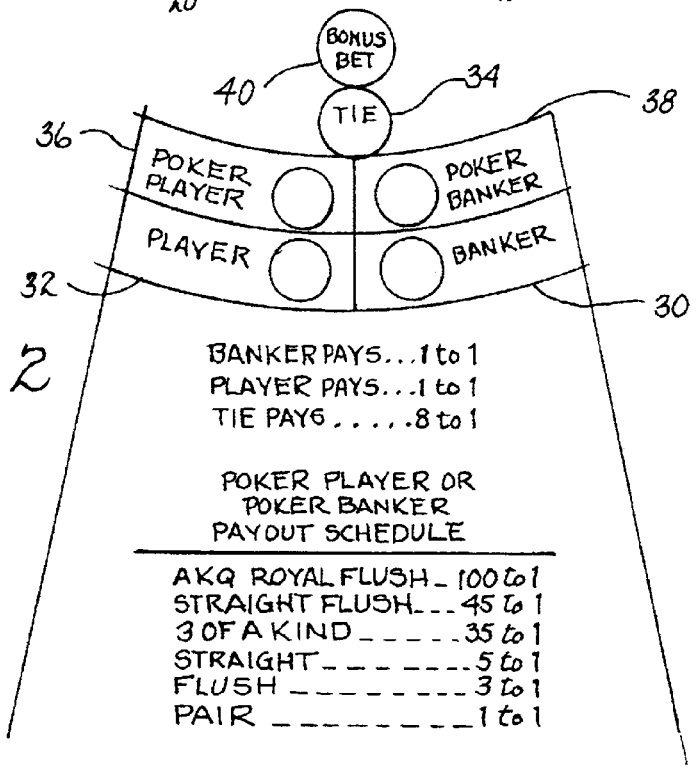
FIG. 2 is an enlarged view of one set of betting options that is located on the table in front of each player wherein seven such sets of betting options are provided (only one of the seven such betting options is shown in FIG. 1).

Referring now to FIGS. 1–2, in the preferred embodiment, the method of playing the combined poker and baccarat-type card game of this invention further comprises the step of at least one player (not shown) wagering a wager on one of the player hand 14 and the banker hand 16. When making a wager for the player hand 14, the player will place the wager amount in the player wagering area 32 and when making a wager for the banker hand 16, the player will place the wager amount in the banker wagering area 30. The method preferably further comprises the step of paying the at least one player an amount equal to the wager when the player wagers on a hand subsequently determined to be a winning hand. While, in the preferred embodiment, a player may wager a wager on one of the player hand 14 and the banker hand 16 it should be clearly understood that substantial benefit could be derived from an alternative embodiment of the present invention in which the combined poker and baccarat-type card game is played without wagers.

In the method of this invention, the player is permitted to select a poker hand from at least one of the player hand 14 and the banker hand 16 to permit the player to be eligible to receive a corresponding bonus payout if any selected poker hand receives one of a pair, a three-card flush (i.e. any three cards of the same suit (e.g., 6 of hearts, 8 of hearts and Jack of hearts)), a three-card straight (i.e. three consecutive cards not having the same suit (e.g., 5 of hearts, 6 of spades and 7 of diamonds)), three of a kind, a three-card straight flush (i.e. three consecutive cards having the same suit (e.g., 8 of diamonds, 9 of diamonds and 10 of diamonds)), and a three-card royal flush comprising an Ace, King and a Queen of any one suit (i.e. the highest three cards of Ace, King and Queen of the same suit (e.g., Ace King & Queen of Spades)).

In one embodiment of the method of playing the combined poker and baccarat-type card game of this invention, a player is permitted to wager a pre-determined amount in order to become eligible to receive the corresponding bonus payout in the event that the poker hand receives one of a pair, a three-card flush, a three-card straight, three of a kind, a three-card straight flush, and a three-card royal flush comprising an Ace, King and a Queen of any one suit. In this embodiment, the bonus payout is not automatic, and can only be received if the player pays a pre-determined amount prior to receiving his or her cards, and then receives a poker hand having one of a pair, a three-card flush, a three-card straight, three of a kind, a three-card straight flush, and a three-card royal flush comprising an Ace, King and a Queen of any one suit. While, in this embodiment, the bonus payout is optional and can only be received if a player both pays a pre-determined amount and has a poker hand that qualifies for bonus payout, it should be clear that substantial benefit could be derived from an alternative embodiment of the combined poker and baccarat-type card game in which a player automatically qualifies for the bonus payout without having to pay a pre-determined amount.

In the preferred embodiment, the bonus payout is 100 to 1 for a three-card royal flush, 45 to 1 for a three-card straight flush, 35 to 1 for a three of a kind, 5 to 1 for a three-card straight, 3 to 1 for a three-card flush and a return of the amount wagered for a pair. However, it should be clearly understood that substantial benefit could be derived from an alternative embodiment of the present invention in which a different bonus payout schedule is used.

Although as few as one player could play the combined poker and baccarat-type card game of the present invention, it should be clearly understood that as many as 7 players are capable of playing the combined poker and baccarat-type card game of this invention.

In the preferred embodiment, the method of playing the combined poker and baccarat-type card game of this invention further includes the step of permitting a player to select both the player hand 14 and the banker hand 16 to be eligible to receive the corresponding bonus payout if either the player hand 14 or the banker hand 16 receives one of a pair, a three-card flush, a three-card straight, a three of a kind, a three-card straight flush, and a three-card royal flush. In this way, a player could wager on a poker hand from either the player hand 14, the banker hand 16 or both the player hand 14 and the banker hand 16 in order to be eligible to receive the corresponding bonus payout. While, in the preferred embodiment, the player can select either the player hand 14, the banker hand 16 or both the player hand 14 and the banker hand 16, it should be clearly understood that substantial benefit could be derived from an alternative embodiment, in which the player can only select one of the player hand 14 and the banker hand 16.

In the preferred embodiment, the method of playing the combined poker and baccarat-type card game of this invention further includes the step of permitting a player to select both the player hand 14 and the banker hand 16 to be eligible to receive the corresponding bonus payout if a combination of the player hand 14 and the banker hand 16 results in one of three pairs, four of a kind, a six-card straight, a six-card flush, a six-card straight flush and a six-card straight flush of 9, 10, Jack, Queen, King and Ace of any one suit. Another embodiment of this method would pay a player a jackpot amount if the combination of the player hand 14 and the banker hand 16 results in a six card royal flush of 9, 10, Jack, Queen, King and Ace of any one suit with the 9, 10, Jack in one of the player hand area 24 and the banker hand area 26 and the Queen, King, Ace on the other of the player hand area 24 and the banker hand area 26. Alternatively, the player could be paid a jackpot amount if the player hand 14 and the banker hand 16 results in a six card royal flush of 9, 10, Jack, Queen, King and Ace of any one suit with the 9, 10, Jack in the player hand area 24 and the Queen, King, Ace in the banker hand area 26. While, in the preferred embodiment, the method of playing a combined poker and baccarat-type card game includes various betting alternatives such as allowing a player to select both the player hand 14 and the banker hand 16 in order to qualify for the corresponding bonus payout, and paying a player a jackpot if the player receives a 6 card royal flush with or without the 9, 10 and Jack in the player hand area 24 and the Queen, King and Ace in the banker hand area 26, it should be clearly understood that substantial benefit could be derived from an alternative embodiment of the present invention in which these betting options were not available.

Referring now to FIGS. 1–2, in the preferred embodiment, the method of playing the combined poker and baccarat-type card game of this invention further includes the step of dealing an additional playing card on a tie breaker area 28 (shown in FIG. 1) when the player hand 14 and the banker hand 16 are subsequently determined to have an equal hand value. Preferably, the method of playing the combined poker and baccarat-type card game of this invention further comprises paying the player an amount equal to the wager when the additional tie breaker card is one of 10, Jack, Queen, King and Ace. When the additional tie breaker card is one of 2, 3, 4, 5, 6, 7, 8, and 9, then the player pays the dealer an amount equal to the wager. In another embodiment, the dealer pays the players an amount equal to the wager when the additional tie breaker card is one of Ace, 3, 5, 7 and 9. When the additional tie breaker card is one of 2, 4, 6, 8, 10, Jack, Queen and King, then the player pays the dealer an amount equal to the wager, In one embodiment of the method of playing the combined poker and baccarat-type card game of this invention, the dealing of an additional tie-breaking card is automatic. While, in the preferred embodiment, the method of playing the combined poker and baccarat-type card game includes a step for dealing an additional card as a tie-breaker, it should be clearly understood that substantial benefit could be derived from an alternative embodiment of the present invention in which no tie-breaker card is dealt, or in which the tie-breaker card is not dealt automatically.

In the preferred embodiment, the method of playing the combined poker and baccarat-type card game of this invention further comprises the step of a player wagering a wager on a tie wagering area 34 that the player hand 14 will have a hand value subsequently determined to be equal to the banker hand 16. The player will then be paid a multiple of the wager when the player hand 14 and the banker hand 16 are subsequently determined to have an equal hand value. Preferably, the multiple is 8, although to maintain a statistical advantage for the house, the multiple can be any number less than 10.

While, in the preferred embodiment, the method of playing the combined poker and baccarat-type card game of this invention comprises the steps of at least one player wagering a wager, and paying the at least one player an amount equal to the wager when the player wagers on a hand subsequently determined to be a winning hand, or paying the at lest one player a multiple of the wager when the player wagers that the banker hand 16 and the player hand 14 will have an equal hand value, it should be clearly understood that substantial benefit could be derived from an alternative embodiment of the method of playing the combined poker and baccarat-type game of this invention in which there is no wagering.

Referring now to FIG. 1, a combined poker and baccarat-type card game table 20 is shown. The combined poker and baccarat-type card game table 20 comprises a table 22 having a banker hand area 26 dimensioned to receive the three playing cards of the banker hand 16 and a player hand area 24 dimensioned to receive the three playing cards of the player hand 14. The combined poker and baccarat-type card game table 20 further comprises a plurality of individual betting locations located proximate an outer perimeter of the table 22. Preferably, the combined poker and baccarat-type card game table 20 comprises 7 betting locations, although it should be clearly understood that substantial benefit could be derived from an alternative embodiment of the combined poker and baccarat-type card game table 20 in which the number of individual betting locations deviates, even substantially, from the preferred number of betting locations, in either direction.

Still referring to FIG. 1 and FIG. 2, each of the individual betting locations has a banker wagering area 30 designated for wagering on a banker hand 16 and a player wagering area 32 designated for wagering on a player hand 14. The combined poker and baccarat-type card game table 20 further comprises a tie wagering area 34 located proximate the plurality of individual betting locations. The tie wagering area 34 is designated for wagering that the banker hand 16 and the player hand 14 will subsequently be determined to have an equal hand value. Preferably, the combined poker and baccarat-type card game table 20 utilizes a single deck of playing cards, although it should be clearly understood that substantial benefit could be derived from the use of multiple decks of playing cards.

Previously, three-card poker games have been created and have been introduced into play in some casinos. However, the previous three-card poker games that have been introduced or implemented have a problem in that some players can do the cheating by bending or marking the cards while they are holding the cards in their hands. Another weakness of the prior three-card poker game is that the player can only play the three cards allocated to the player and cannot play the three cards that are designated for the dealer or in this disclosure, the banker.

These two disadvantages of the prior three-card poker game have been overcome by the combined poker and baccarat game of this invention. Firstly, the cards for the player hand 14 and banker hand 16 are put in front of the players facing up, and the players are not allowed to touch the cards. Hence, bending or marking cards by the players are prevented. Secondly, each player at the table 22 can, in addition to playing baccarat, play three-card poker and can select either to place a wager for the player in an area designated poker player wagering area 36 or in an area designated poker banker wagering area 38 for the banker. For example, if the player selects placing a wager in the player wagering area 32 (which will permit the player to win at baccarat if the player's hand 14 is better, under baccarat rules, than the banker hand 16), the player can also place a wager in either the poker player wagering area 36 or, if desired, in the poker banker wagering area 38, or, if further desired, in both the poker player wagering area 36 and the poker banker wagering area 38. Accordingly, if, for example, a player selects placing a wager in the poker player wagering area 36, then the player can receive a bonus poker payout as set forth in FIG. 2. This is the same if the player selects the poker banker wagering area 38 to wager on the banker's hand 16 receiving one of the poker bonus hands as set forth in FIG. 2. If the player places a wager in both the poker player wagering area 36 and in the poker banker wagering area 38, then if either the player hand area 24 or the banker hand area 26 receive playing cards that are eligible for one of the poker bonus payout, the player will receive such a poker bonus payout for either or conceivably both hands.

The implementation of the combined poker and baccarat game of this invention can be used in video machines, slot machines scratch-card formats, computer software, home and internet entertainment and can also be implemented in various types of computer program products such as floppy disks, compact disks, etc. The combined poker and baccarat-type game is played with a single deck; however, multiple decks of cards can be used, if desired.

In another preferred embodiment, an arrangement can be made for players to make an additional bonus wager or bet of one dollar or any designated amount to be placed on the progressive jackpot bonus bet wagering area 40. The players will be eligible to win part of or an entire progressive jackpot amount that has been separately set aside by one or more tables or casinos for this combined poker and baccarat-type game. For example, if the six combined cards of both the player hand 14 and the banker hand 16 provides three separate pairs or a four of a kind or a six card straight or a six card flush or a six card straight flush or the six card royal flush of 9, 10, Jack, Queen, King and Ace of any one of the four suits, then the player will win at least a portion of the progressive jackpot poker hand designations. Preferably, the entire progressive jackpot is paid for the highest six card straight flush where 9, 10, Jack in any order are proximate the player hand area 24, and Queen, King and Ace in any order are proximate the banker hand area 26. If more than one player receives a six card royal flush in the same game, then each winning player will split the total progressive jackpot amount. Each casino can determine whether or not to implement this progressive jackpot.

While the invention has been particularly shown and described with reference to preferred embodiments thereof, it will be understood by those skilled in the art that the foregoing and other changes in form and details may be made therein without departing from the spirit and scope of the invention.

I claim:

1. A method of playing a combined poker and baccarat-type card game comprising, in combination, the steps of:

dealing a player hand having three cards;

dealing a banker hand having three cards;

determining a hand value of said player hand, wherein Ace through Nine cards have respective point values of 1 to 9 and wherein 10's and Jacks and Queens and Kings have a point value of zero, wherein a hand value of said player hand is equal to a total point value of said three cards of said player hand when said three cards have a total point value less than 10 and when said three cards of said player hand have a total point value of at least 10 then the first digit of said total point value is ignored when determining a hand value of said player hand;

determining a hand value of said banker hand, wherein Ace through 9 cards have respective point values of 1 to 9 and wherein 10's and Jacks and Queens and Kings have a point value of zero, wherein a hand value of said banker hand is equal to a total point value of said three cards of said banker hand when said three cards have a total point value less than 10 and when said three cards of said banker hand have a total point value of at least 10 then the first digit of said total point value is ignored when determining a hand value of said banker hand;

comparing said hand value of said player hand with said hand value of said banker hand wherein the hand having the higher number is a winning hand;

permitting a player to select a poker hand from at least one of said player hand and said banker hand to permit said player to be eligible to receive a corresponding bonus payout if any selected poker hand receives one of a pair, a three-card flush, a three-card straight, three of a kind, a three-card straight flush, and a three-card royal flush comprising an Ace and a King and a Queen of any one suit;

at least one player wagering a wager on one of said player hand and said banker hand;

dealing an additional card as a tie breaker card when said player hand and said banker hand are subsequently determined to have an equal hand value; and paying said at least one player an amount equal to said wager when said additional card is one of 10, Jack, Queen, King and Ace, said at least one player pays a dealer an amount equal to said wager when, said additional card is one of 2, 3, 4, 5, 6, 7, 8, and 9.

2. A method of playing a combined poker and baccarat-type card game comprising, in combination, the steps of:

dealing a player hand having three cards;

dealing a banker hand having three cards;

determining a hand value of said player hand, wherein Ace through Nine cards have respective point values of 1 to 9 and wherein 10's and Jacks and Queens and Kings have a point value of zero, wherein a hand value of said player hand is equal to a total point value of said three cards of said player hand when said three cards have a total point value less than 10 and when said three cards of said player hand have a total point value of at least 10 then the first digit of said total point value is ignored when determining a hand value of said player hand;

determining a hand value of said banker hand, wherein Ace through 9 cards have respective point values of 1 to 9 and wherein 10's and Jacks and Queens and Kings have a point value of zero, wherein a hand value of said banker hand is equal to a total point value of said three cards of said banker hand when said three cards have a total point value less than 10 and when said three cards of said banker hand have a total point value of at least 10 then the first digit of said total point value is ignored when determining a hand value of said banker hand;

comparing said hand value of said player hand with said hand value of said banker hand wherein the hand having the higher number is a winning hand;

permitting a player to select a poker hand from at least one of said player hand and said banker hand to permit said player to be eligible to receive a corresponding bonus payout if any selected poker hand receives one of a pair, a three-card flush, a three-card straight, three of a kind, a three-card straight flush, and a three-card royal flush comprising an Ace and a King and a Queen of any one suit;

at least one player wagering a wager on one of said player hand and said banker hand;

dealing an additional card as a tie breaker card when said player hand and said banker hand are subsequently determined to have an equal hand value; and paying said at least one player an amount equal to said wager when said additional cards is one of Ace, 3, 5, 7, and 9, said at least one player pays a dealer an amount equal to said wager when said additional cards is one of 2, 4, 6, 8, 10, Jack, Queen and King.

* * * * *